US008161766B2

(12) United States Patent
Shin et al.

(10) Patent No.: US 8,161,766 B2
(45) Date of Patent: Apr. 24, 2012

(54) REFRIGERATOR ICE BIN WITH THERMAL STORAGE MEMBER

(75) Inventors: Jong Min Shin, Busan (KR); Ju Hyun Kim, Jinhae (KR)

(73) Assignee: LG Electronics Inc., Seoul (KR)

( * ) Notice: Subject to any disclaimer, the term of this patent is extended or adjusted under 35 U.S.C. 154(b) by 514 days.

(21) Appl. No.: 11/969,042

(22) Filed: Jan. 3, 2008

(65) Prior Publication Data

US 2008/0156024 A1 Jul. 3, 2008

(51) Int. Cl.

| | |
|---|---|
| ***F25C 5/18*** | (2006.01) |
| ***F25D 23/12*** | (2006.01) |
| ***F25D 25/00*** | (2006.01) |
| ***F25D 17/04*** | (2006.01) |
| ***F25D 3/02*** | (2006.01) |

(52) U.S. Cl. ..... 62/344; 62/337; 62/377; 62/406; 62/420

(58) Field of Classification Search ..... 62/105, 62/406, 420, 425, 428, 344, 353, 407, 529–530
See application file for complete search history.

(56) References Cited

U.S. PATENT DOCUMENTS

| | | | | |
|---|---|---|---|---|
| 6,062,037 | A * | 5/2000 | Yoon | 62/407 |
| 6,604,377 | B2 * | 8/2003 | Watanabe et al. | 62/408 |
| 7,188,479 | B2 * | 3/2007 | Anselmino et al. | 62/66 |
| 2001/0025505 | A1 * | 10/2001 | Nelson et al. | 62/371 |
| 2004/0250566 | A1 * | 12/2004 | Roth et al. | 62/457.2 |

* cited by examiner

*Primary Examiner* — Frantz Jules
*Assistant Examiner* — Cassey D Bauer
(74) *Attorney, Agent, or Firm* — KED & Associates, LLP

(57) ABSTRACT

The present invention relates to a refrigerator, and more particularly, to a structure for allowing ice, which is received in an ice-storing device provided in a refrigerating chamber door, to be in a frozen state without being melted. The refrigerator of the present invention comprises a main body including at least a refrigerating chamber, a door for opening or closing the refrigerating chamber, a container provided in the door to store ice therein, and a cold heat storage member surrounding the container. According to the refrigerator of the present invention constructed as above, even though an ice bank for storing ice is provided in a refrigerating chamber door, it is possible to prevent a phenomenon by which ice is melted and stuck together.

11 Claims, 5 Drawing Sheets

REFRIGERATOR ICE BIN WITH THERMAL STORAGE MEMBER

BACKGROUND OF THE INVENTION

1. Field of the Invention

The present invention relates to a refrigerator, and more particularly, to a structure for allowing ice, which is received in an ice-storing device provided in a refrigerating chamber door, to be in a frozen state without being melted.

2. Description of the Related Art

Generally, a refrigerator is an electric home appliance for storing foods in a low temperature state so that the foods can be kept in a fresh state for an extended period of time.

Specifically, a refrigerator includes a refrigerating chamber that is maintained in a temperature range of 1 to 4° C. to store foods such as vegetables in a fresh state, and a freezing chamber that is maintained at about −18° C. to store foods such as meat or fish in a frozen state.

In addition, refrigerators are classified into a type in which a freezing chamber is positioned above a refrigerating chamber, a type in which a freezing chamber is positioned below a refrigerating chamber, and a type in which a freezing chamber and a refrigerating chamber are positioned side by side.

Alternatively, refrigerators may be classified into a side-by-side door refrigerator having right and left doors, and a single-side door refrigerator having upper and lower doors.

Meanwhile, an ice maker for making ice and an ice bank for storing the ice are provided in any one of the refrigerating chamber and the freezing chamber.

Specifically, in a case where the ice maker and the ice bank are provided in the freezing chamber, water stored in the ice maker is made into ice by means of a refrigerant that has passed through an evaporator, and the ice falls into and stored in the ice bank provided below the ice maker.

Meanwhile, in some refrigerators, the ice maker is provided in the refrigerating chamber, and the ice bank is provided at a refrigerating chamber door. In this case, since the refrigerating chamber is kept at a temperature above zero, the ice stored in the ice bank may be partially melted and stuck again together.

Specifically, in a case where ice is melted and stuck together, there is a problem in that an overload may be applied to an ice crusher provided in the ice bank. More specifically, in a case where an overload is applied to the ice crusher, parts such as a motor for operating the ice crusher or a blade for crushing ice may be damaged. As a result, there is a disadvantage in that the life span of the ice bank is shortened, resulting in additional repair or replacement costs.

SUMMARY OF THE INVENTION

The present invention is conceived to solve the aforementioned problems. Accordingly, an object of the present invention is to provide a refrigerator, wherein ice stored in an ice bank provided at a refrigerating chamber door is kept in a frozen state without being melted.

Specifically, an object of the present invention is to provide a refrigerator, wherein ice stored in an ice bank is prevented from being melted and stuck together so that an ice crusher for crushing the ice is not damaged.

A refrigerator according to one aspect of the present invention for achieving the objects comprises a main body including at least a refrigerating chamber, a door for opening or closing the refrigerating chamber, a container provided in the door to store ice therein, and a cold heat storage member surrounding the container.

A refrigerator according to another aspect of the present invention comprises a main body including a refrigerating chamber and a freezing chamber, a door for opening or closing the refrigerating chamber, a container provided in the door to store ice therein, a cold heat storage member provided at an entire or partial portion of the container; and a cold air duct provided in the main body to discharge cold air directly to the container.

With the structure described above, there is an advantage in that ice stored in the ice bank provided at the refrigerating chamber door can be kept in a frozen state without being melted.

BRIEF DESCRIPTION OF THE DRAWINGS

The above and other objects, features and advantages of the present invention will become apparent from the following description of preferred embodiments given in conjunction with the accompanying drawings, in which.

DESCRIPTION OF THE PREFERRED EMBODIMENTS

Hereinafter, a specific embodiment of the present invention will be described in detail with reference to the accompanying drawings. However, the spirit of the present invention is not limited to the following embodiment, and retrograde embodiments or other embodiments included in the scope of the present invention can be easily conceived by adding, changing or eliminating other components.

Figure 1:
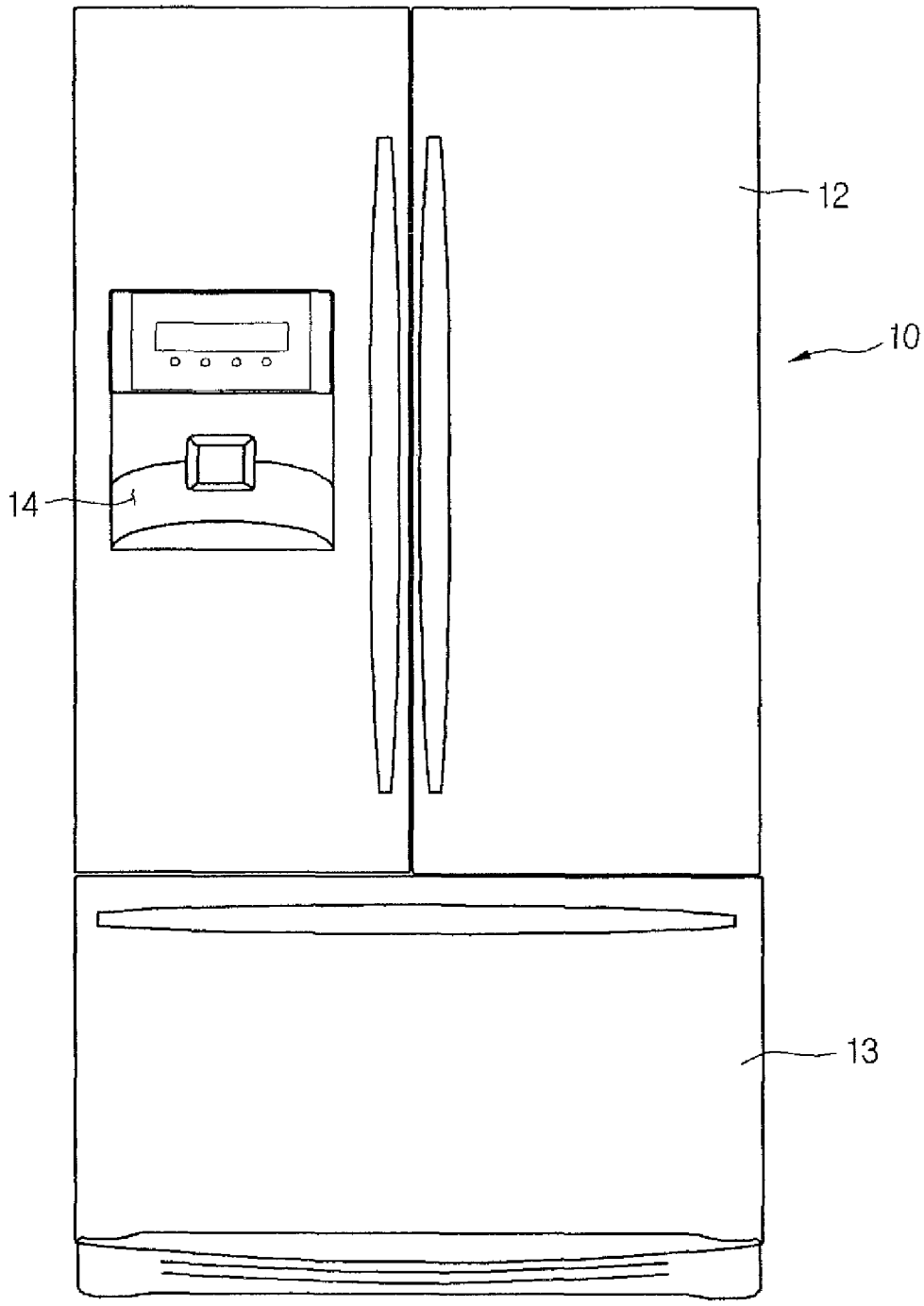
FIG. 1 is a front view of a refrigerator according to the present invention.
Figure 2:
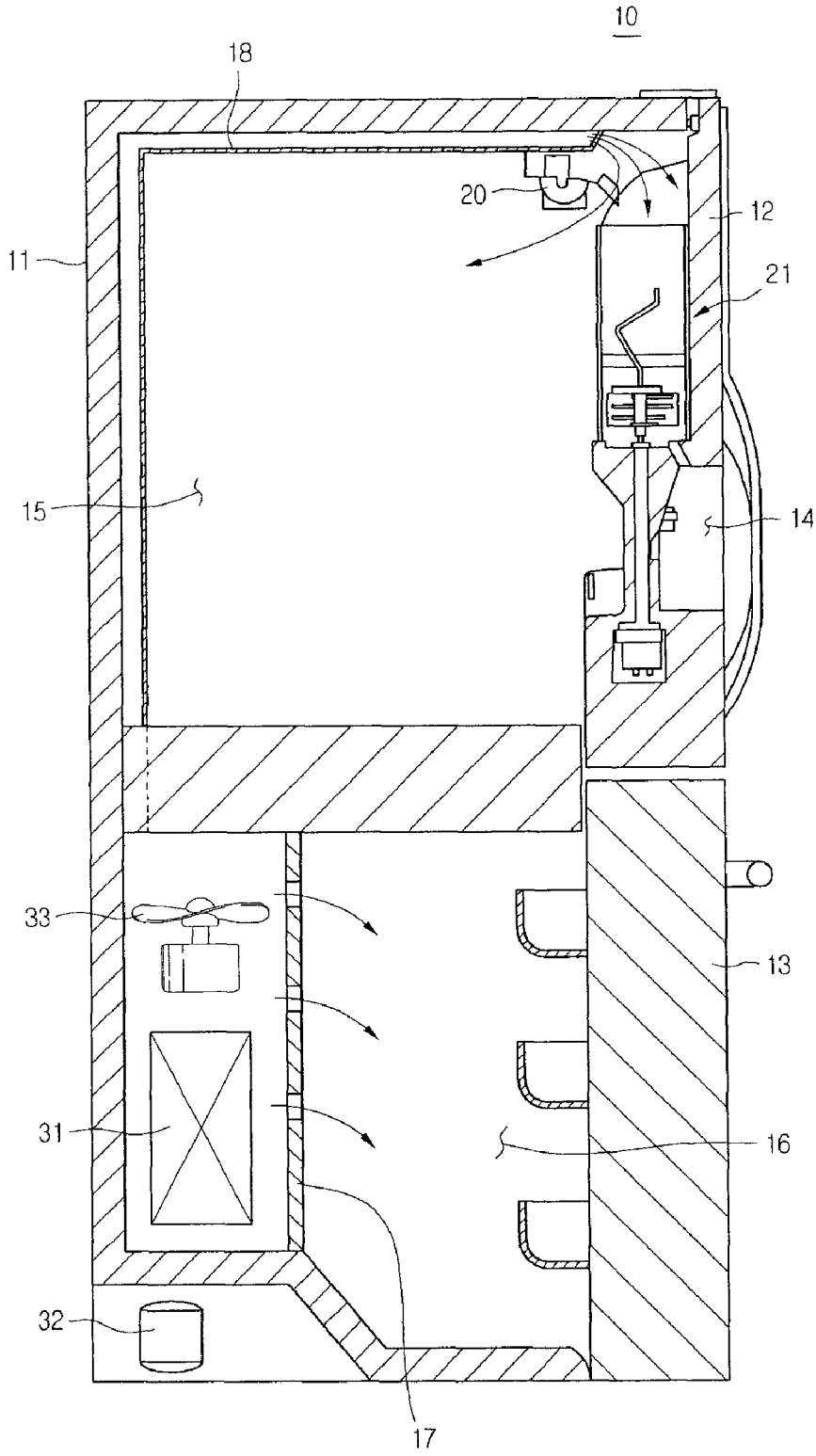
FIG. 2 is a side sectional view showing the refrigerator according to the present invention.

FIG. 1 is a front view of a refrigerator according to the present invention, and FIG. 2 is a side sectional view showing the refrigerator according to the present invention.

Referring to FIGS. 1 and 2, the refrigerator of the present invention will be described by way of example in connection with a bottom-freezer type refrigerator in which a refrigerating chamber is provided at an upper portion and a freezing chamber is provided at a lower portion.

The refrigerator 10 of the present invention includes a main body 11 having a refrigerating chamber 15 and a freezing chamber 16 provided therein, refrigerating chamber doors 12 for opening or closing the refrigerating chamber 15, and a freezing chamber door 13 for opening or closing the freezing chamber 16. Specifically, the refrigerating chamber 15 and the freezing chamber 16 are partitioned by means of a barrier 111.

In addition, the refrigerator 10 further includes a compressor 32 provided at a lower portion of the main body 11 to compress a refrigerant, an evaporator 31 disposed at a rear portion of the main body 11 to generate cold air, and a blower fan 30 for causing the cold air generated by the evaporator 31 to be supplied into the refrigerating chamber 15 and the freezing chamber 16.

Moreover, the refrigerator 10 further includes a freezing duct 17 for supplying the cold air blown by the blower fan 30 to the freezing chamber 16, a refrigeration duct 18 for supplying the cold air to the refrigerating chamber 15, an ice maker 20 provided on a ceiling of the refrigerating chamber 15, and an ice bank 21 for storing ice made by the ice maker 20.

Specifically, the freezing duct 17 is provided with a plurality of cold air holes, and the cold air is discharged into the freezing chamber 16 through the cold air holes. Here, in addition to the structure in which the evaporator 31 and the blower fan 30 are disposed in the freezing duct 17, the evaporator 31 and the blower fan 30 may be provided in a separate space in the main body 11 and a freezing duct 17 connected to the freezing chamber 16 may be separately provided.

Furthermore, the refrigeration duct 18 extends from a space where the evaporator 31 is accommodated, and is then connected to the refrigerating chamber 15 through the barrier 111. Here, in addition to the structure in which the refrigeration duct 18 communicates directly with the space with the evaporator 31 accommodated therein, it should be noted that the refrigeration duct 18 may be branched off from the freezing duct 17.

As shown in the figures, the refrigerating chamber doors 12 are generally provided as side-by-side doors, and the freezing chamber door 13 is generally in the form of a drawer-type door. However, the freezing chamber door 13 may also be provided in the form of side-by-side doors.

With the structure described above, ice made by the ice maker 20 provided on the ceiling of the refrigerating chamber 15 is separated by an ejector (not shown) and then falls into the ice bank 21. Here, a guide extending from the ice maker 20 or the ice bank 21 may be provided such that the ice separated from the ice maker 20 can safely fall into the ice bank 21.

Specifically, the ice bank 21 has an upper face in the form of an opening, and the opening of the ice bank 21 is positioned below the ice maker 20 when the refrigerating chamber doors 12 are closed. In addition, ice may be made by supplying cold air directly to the ice maker 20 or by providing an additional refrigerant conduit to the ice maker.

Meanwhile, in a case where the ice bank 21 is provided in the refrigerating chamber 15 or the refrigerating chamber door 12, there may be a phenomenon by which ice stored in the ice bank is melted and stuck together since the refrigerating chamber 15 is kept at a temperature above zero.

To solve this problem, it is necessary to always maintain the interior of the ice bank 21 at a temperature below zero so that ice is not melted.

Meanwhile, the refrigeration duct 18 communicates with the space where the evaporator 31 is accommodated, and then extends upward along a wall of the refrigerating chamber 15 and to the ceiling of the refrigerating chamber 15. Then, an end of the refrigeration duct 18 extends to a front portion of the refrigerating chamber 15 and is positioned above the container 211 of the ice bank 21. Thus, cold air flowing along the refrigeration duct 18 is discharged forward, and a portion of the discharged cold air falls into the container 211, and the remainder of the cold air circulates in the refrigerating chamber 15.

With this structure, at least a portion of cold air, which has been cooled to a lower temperature while passing through the evaporator 31, is discharged directly into the container 211, thereby effectively preventing a phenomenon by which ice accommodated in the container 211 is melted and stuck together.

Further, since the refrigeration duct 18 extends to the front portion of the refrigerating chamber 15 and the cold air discharged from the refrigeration duct 18 is discharged downward, it is possible to obtain an air curtain effect.

Figure 3:
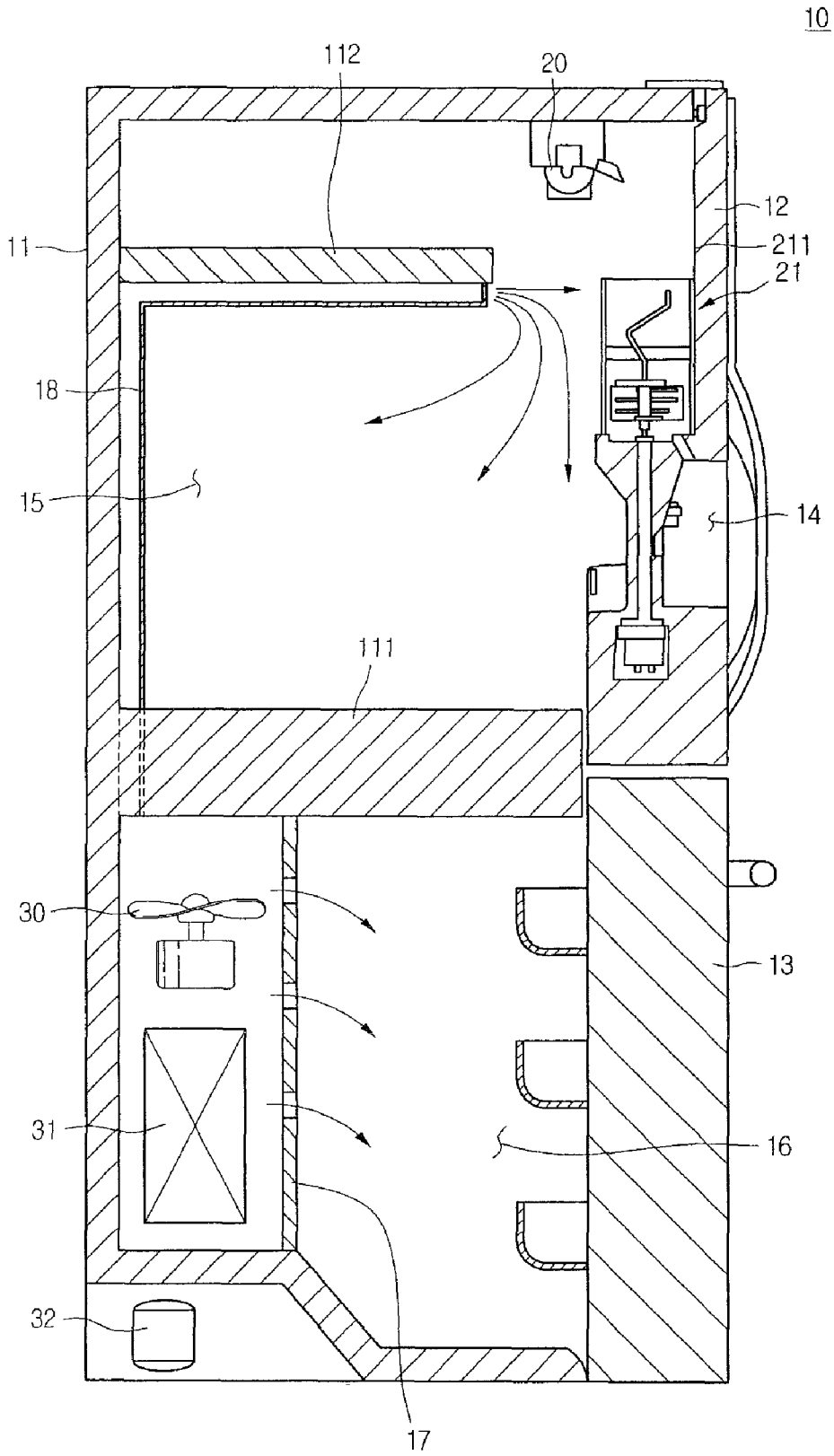
FIG. 3 is a side sectional view showing a refrigerator according to another embodiment of the present invention.

FIG. 3 is a side sectional view showing a refrigerator according to another embodiment of the present invention.

Referring to FIG. 3, the refrigeration duct 18 for allowing cold air to be discharged toward the ice bank 21 is characterized by extending forward along a bottom surface of a shelf 112. Since the other constitutions of this embodiment are substantially identical with those of the embodiment shown in FIG. 2, detailed descriptions thereof will be omitted.

Specifically, the refrigeration duct 18 extends from the space where the evaporator 31 is accommodated, and is then connected to the refrigerating chamber 15 through the barrier 111. More specifically, the refrigeration duct 18 extends upward along a rear surface of the refrigerating chamber 15 and then extends forward along the bottom surface of the shelf 112. In addition, discharge ports provided at an end of the refrigeration duct 18 are positioned above the ice bank 21. Thus, a portion of the cold air discharged from the refrigeration duct 18 is discharged toward the ice bank 21, and the remainder of the cold air circulates in the refrigerating chamber 15.

Figure 4:
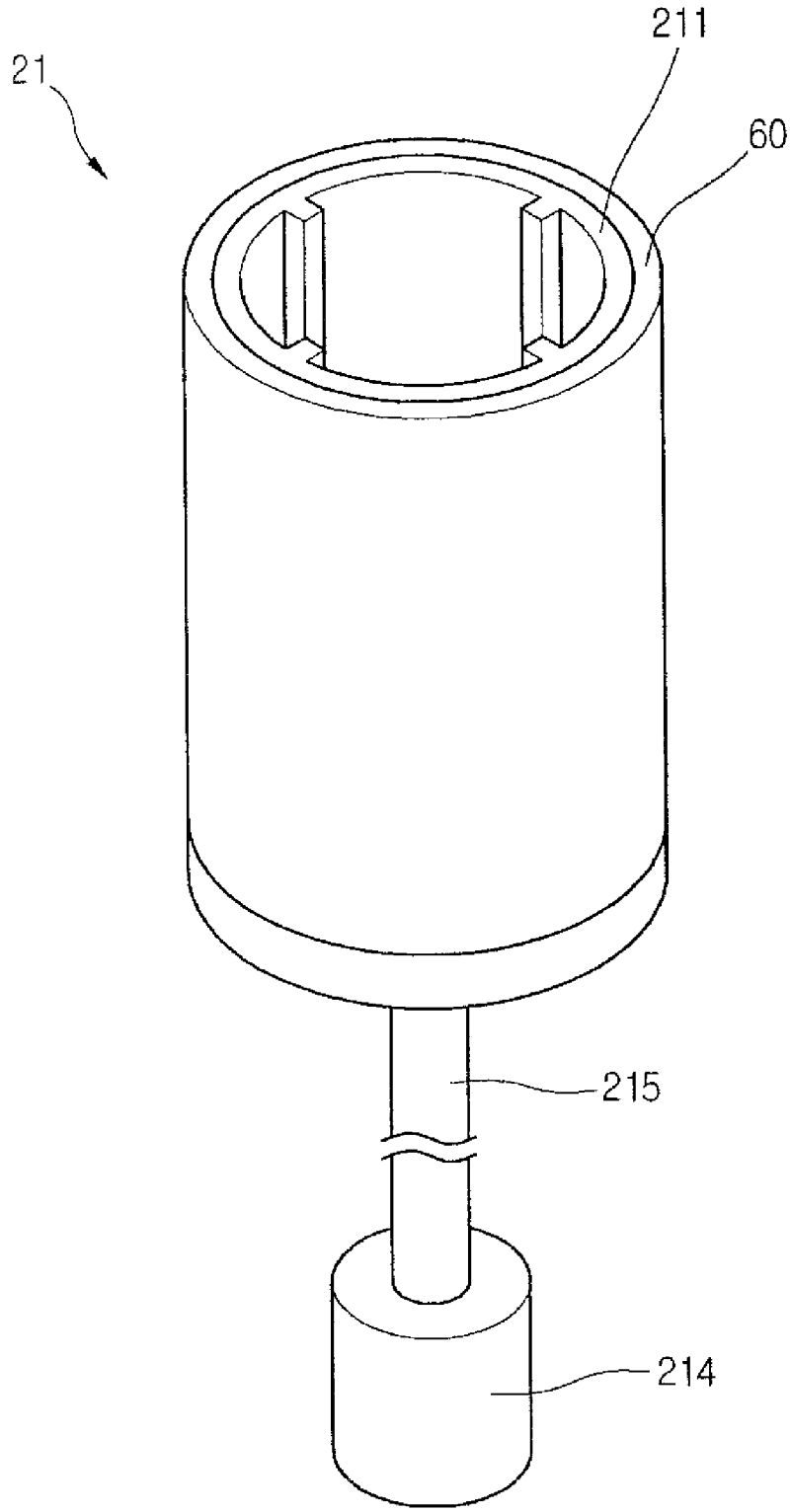
FIG. 4 is a perspective view showing the structure of an ice bank of the refrigerator according to the present invention.
Figure 5:
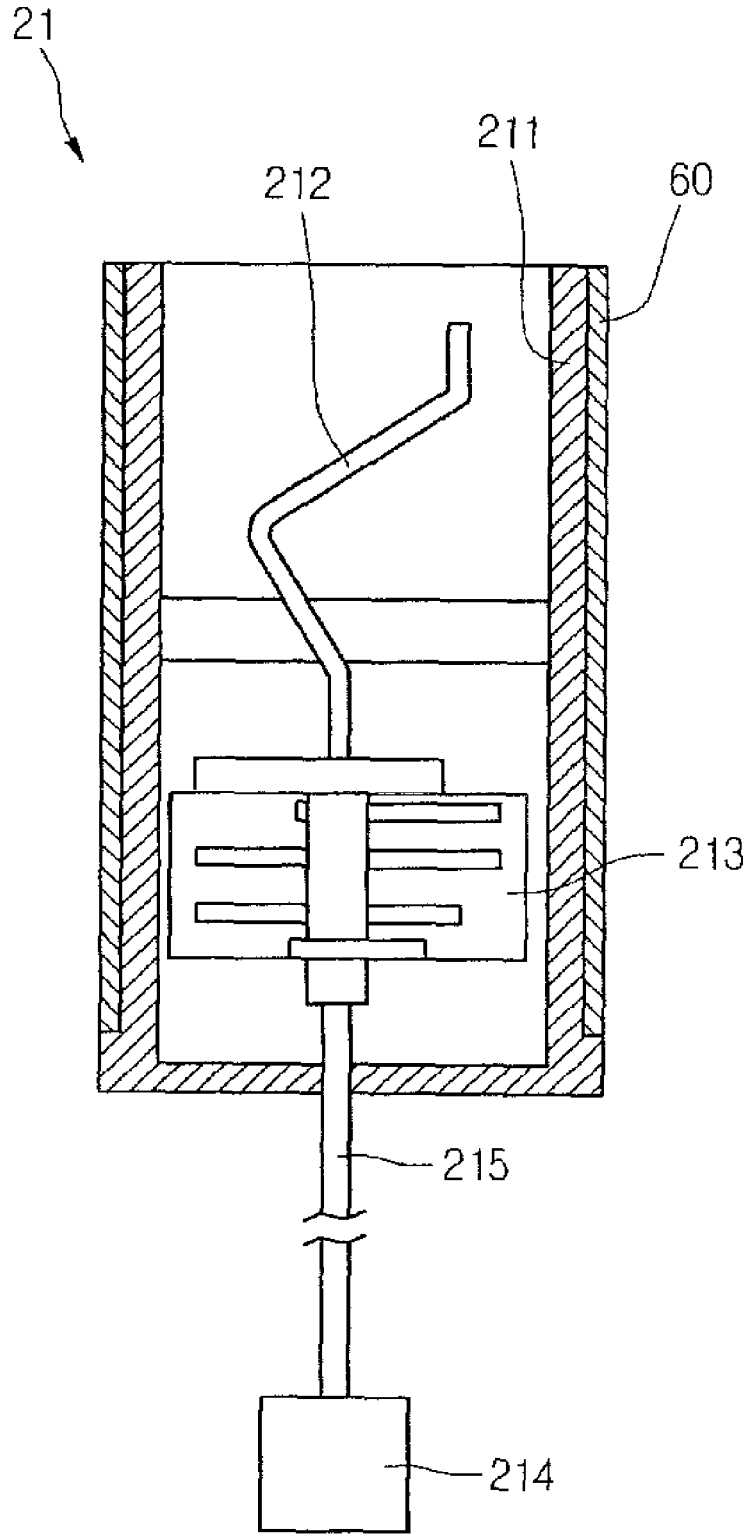
FIG. 5 is a vertical sectional view showing the ice bank of the refrigerator according to the present invention.

FIG. 4 is a perspective view showing the structure of an ice bank of the refrigerator according to the present invention, and FIG. 5 is a vertical sectional view showing the ice bank of the refrigerator according to the present invention.

Referring to FIGS. 4 and 5, the ice bank 21 of the present invention includes a cylindrical container 211 with an open upper portion, a cold heat storage member 60 surrounding the container 211, an auger 212 provided at an inner lower portion of the container 211 to guide ice downward, a crusher 213 integrally connected to a lower end of the auger 212 to crush ice, a motor 214 for driving the crusher 213, and a shaft 215 for connecting the motor 214 to the crusher 213 so as to transmit a rotational force of the motor.

Furthermore, the ice maker 20 is provided at a side of the ceiling of the refrigerating chamber 15. Specifically, the ice maker 20 is positioned above the ice bank 21 such that ice discharged from the ice maker 20 can fall into the container 211.

Here, since any kind of ice maker can be used as the ice maker 20, a detailed description of the structure thereof will be omitted.

Although the cold heat storage member 60 is illustrated to surround an outer peripheral surface of the container 211 as a preferred embodiment, it is not limited thereto. It should be noted that the cold heat storage member 60 may be disposed to surround an inner peripheral surface of the container 211 or to be embedded in the container 211.

As for the material of the cold heat storage member 60, a liquid cold heat storage material that is generally used in the art may be employed. That is, a cold heat storage material in which potassium hydrogen carbonate and ethyl alcohol are mixed may be used. It should be noted that the cold heat storage material is not limited to particular materials.

Since the cold heat storage member 60 surrounds the container 211, the cold air discharged from the refrigeration duct 18 is stored in the cold heat storage member 60. Thus, ice stored in the container 211 can be kept in a frozen state without being melted.

According to the refrigerator of the present invention constructed as above, even though an ice bank for storing ice is provided in a refrigerating chamber door, it is possible to prevent a phenomenon by which ice is melted and stuck together.

Further, since ice is not melted and stuck together, it is possible to prevent a phenomenon by which an overload is applied to an ice crusher provided in the ice bank.

In addition, since an overload is not applied to the ice crusher, components such as a motor for driving the ice crusher or a blade for crushing ice are not damaged. Thus, the life span of the ice bank is extended and additional repair and replacement costs are not required.

What is claimed is:

1. A refrigerator, comprising:

a main body including at least a refrigerating chamber and a freezing chamber disposed under the refrigerating chamber;

a first and second refrigerating chamber doors for opening or closing the refrigerating chamber;

an ice maker disposed within the refrigerating chamber so as to be located behind the first refrigerating chamber door on the ceiling of the refrigerated chamber;

a container mounted on the first refrigerating chamber door to be supplied ice from the ice maker and to be exposed to an inside of the refrigerating chamber;

a cold heat storage member surrounding at least a portion of the container;

a dispenser disposed in the first refrigerating chamber door to dispense the ice received in the container;

an evaporator disposed within the freezing chamber to supply cold air; and a cold air flow passage for supplying the cold air from the freezing chamber to the container, wherein the cold heat storage member and the cold air flow passage cooperate to maintain the ice in the container in a frozen state; the cold air flow passage extends towards the door along a shelf member accommodated in the refrigerating chamber such that cold air is discharged downward towards the container.

2. The refrigerator as claimed in claim 1, wherein the cold heat storage member surrounds an inner peripheral surface or outer peripheral surface of the container.

3. The refrigerator as claimed in claim 1, wherein the cold heat storage member surrounds the container while being embedded therein.

4. The refrigerator as claimed in claim 1, wherein the cold air flow passage comprises a duct member having a discharge port positioned above an opening of the container.

5. A refrigerator as claimed in claim 1, wherein the ice maker is disposed adjacent to the cold air flow passage.

6. The refrigerator as claimed in claim 1, wherein the container has an opening at an upper portion, and at least a portion of the cold air discharged from the cold air flow passage is discharged downward to the opening of the container.

7. The refrigerator as claimed in claim 1, wherein the dispenser includes an opening through which the ice is supplied to an outside of the first refrigerating chamber door.

8. The refrigerator as claimed in claim 1, wherein the cold heat storage member is in a liquid phase.

9. The refrigerator as claimed in claim 1, wherein the cold heat storage member includes a solution of ethyl alcohol and potassium hydrogen carbonate.

10. The refrigerator as claimed in claim 1, further comprising an auger vertically arranged in the container.

11. The refrigerator as claimed in claim 1, wherein a portion of the cold air discharged from the cold air flow passage is supplied to the ice maker.

* * * * *